US006483235B1

(12) United States Patent
Iguchi et al.

(10) Patent No.: US 6,483,235 B1
(45) Date of Patent: Nov. 19, 2002

(54) IMAGE DISPLAY APPARATUS WITH RECTANGULAR-SHAPED SPACERS HAVING ADDED TENSIONS

(75) Inventors: Yukinobu Iguchi, Kanagawa (JP); Shinji Kanagawa, Kanagawa (JP)

(73) Assignee: Sony Corporation (JP)

( * ) Notice: Subject to any disclaimer, the term of this patent is extended or adjusted under 35 U.S.C. 154(b) by 0 days.

(21) Appl. No.: 09/365,888

(22) Filed: Aug. 3, 1999

(30) Foreign Application Priority Data

Aug. 4, 1998 (JP) ..... 10-220588

(51) Int. Cl.[7] ..... H01J 1/62; H01J 63/04
(52) U.S. Cl. ..... 313/495; 313/257; 313/292
(58) Field of Search ..... 313/495, 257, 313/292, 258, 422

(56) References Cited

U.S. PATENT DOCUMENTS 5,463,276 A * 10/1995 Kawasaki et al. ..... 313/496
5,649,847 A 7/1997 Haven ..... 445/24
5,936,342 A * 8/1999 Ono et al. ..... 313/495
5,939,823 A * 8/1999 Kiyomiya et al. ..... 313/495
6,111,351 A * 8/2000 Pong et al. ..... 313/422
6,278,066 B1 * 8/2001 Fahlen et al. ..... 174/250

* cited by examiner

*Primary Examiner*—Vip Patel
*Assistant Examiner*—Kevin Quarterman
(74) *Attorney, Agent, or Firm*—Rader, Fishman & Grauer PLLC; Ronald P. Kananen, Esq.

(57) ABSTRACT

To prevent lowering of the brightness of a displayed image, realize satisfactory strength against high pressure and reliably form spacers, an image display apparatus incorporates an anode substrate having a structure in which at least an image display portion is formed on a first substrate; a cathode substrate in which at least an electron emission units are formed on a second substrate and which is disposed opposite to the anode substrate; and spacers each of which formed into a substantially rectangular shape and which are stood erect between the anode substrate and the cathode substrate, wherein the two long sides of the spacer are secured to at least either of the anode substrate or the cathode substrate, and tensions are added to the spacers in the lengthwise direction of the spacers.

10 Claims, 5 Drawing Sheets

IMAGE DISPLAY APPARATUS WITH RECTANGULAR-SHAPED SPACERS HAVING ADDED TENSIONS

BACKGROUND OF THE INVENTION

1. Field of the Invention

The present invention relates to an image display apparatus incorporating paired anode substrate and cathode substrate disposed opposite to each other through a spacer and a manufacturing method therefor, and more particularly to an image display apparatus incorporating electron emission units for emitting field electrons and a manufacturing method therefor.

2. Description of the Related Art

In recent years research and development of an image display apparatus have been performed to reduce the thickness of the display unit. Under the present circumstance, a field emission type display apparatus (hereinafter abbreviated as "FED") incorporating so-called electron emission units has received special attention.

The FED incorporates a cathode substrate having the electron emission unit and an anode substrate having a fluorescent layer and disposed opposite to the cathode substrate. In general, the electron emission units of the cathode substrate are spindt type electron emission units or flat electron emission units. The anode substrate incorporates an anode electrode which is formed below the fluorescent layer and to which anode voltage for accelerating electrons emitted from the electron emission unit is applied.

In the FED, a vacuum state is maintained between the cathode substrate and the anode substrate. Therefore, the cathode substrate and the anode substrate are applied with high pressure from the atmosphere.

Therefore, there is apprehension that the high pressure will cause the cathode and anode substrates disposed opposite to each other to be warped and broken. To prevent the foregoing problem, the FED has been structured such that the thickness of each of the cathode substrate and the anode substrate is enlarged to obtain predetermined strength against high pressures. When a FED having a width across corners of 5 inches is manufactured, a glass substrate having a thickness of about 5 mm is required. When a FED having a width across corners of 10 inches is manufactured, a glass substrate having a thickness of about 10 mm is required. Therefore, a FED having a light weight and small thickness cannot be manufactured.

It might therefore be feasible to employ thin glass substrates each having a thickness of, for example, 1.1 mm to manufacture a cathode substrate and an anode substrate. Moreover, spacers are disposed between the cathode substrate and the anode substrate. Thus, strength against the high pressure caused from the atmosphere is realized. The spacers are exemplified by bead spacers randomly disposed between the cathode substrate and the anode substrate; cylindrical spacers disposed in ineffective pixel regions between the cathode substrate and the anode substrate, and columnar or wall shaped spacers formed between the cathode substrate and the anode substrate by printing or photolithography.

When the bead spacers are employed, the portions in which the bead spacers are formed are made to be ineffective regions. Thus, the brightness of a formed image is lowered. When the distance between the cathode substrate and the anode substrate is elongated to improve electricity resistance between the cathode substrate and the anode substrate, the bead spacers must be enlarged. Hence it follows that the ineffective regions are undesirably enlarged. That is, when the bead spacers are employed, there arises a problem in that the elongation of the distance between the anode substrate and the cathode substrate causes the ineffective regions to undesirably be enlarged.

When columnar spacers are disposed, a plurality of spacers each having a high aspect ratio (height/diameter) are disposed. Therefore, satisfactory strength against high pressure cannot easily be obtained.

When the columnar or wall-shape spacers are employed, the foregoing spacers cannot easily be formed between the cathode substrate and the anode substrate, that is, in a space having a small height of about 1 mm to about 2 mm by printing or photolithography.

As described above, the conventional FED encounters a difficulty in reliably forming a spacer which does not lower the brightness of a displayed image and which has sufficient strength against high pressure. To overcome the foregoing problem, a structure in which a plate-like spacer is disposed has been disclosed in U.S. Pat. No. 564,847. The plate-like spacer is received between rail-like spacer guides provided for the cathode substrate and the anode substrate.

Therefore, spacer guides each having a high aspect ratio must precisely be provided for the cathode substrate and the anode substrate to dispose the plate-like spacer. However, the precise spacer guides each having the high aspect ratio cannot easily be provided for the cathode substrate and the anode substrate. Therefore, the method disclosed in U.S. Pat. No. 564,847 has a problem in that the spacer cannot easily and reliably be formed.

SUMMARY OF THE INVENTION

Accordingly, an object of the present invention is to provide an image display apparatus which is capable of overcoming the foregoing problems experienced with the conventional electron emission units, which does not lower the brightness of the displayed image, which has sufficient strength against high pressure and which permits a spacer to reliably be formed and a manufacturing method therefor.

To achieve the foregoing object, according to one aspect of the present invention, there is provided an image display apparatus comprising: an anode substrate having a structure in which at least an image display portion is formed on a first substrate; a cathode substrate in which at least electron emission units are formed on a second substrate and which is disposed opposite to the anode substrate; and spacers each of which is formed into a substantially rectangular shape and which are stood erect between the anode substrate and the cathode substrate, wherein two long sides of the spacer are secured to at least either of the anode substrate or the cathode substrate, and tensions are added to the spacers in the lengthwise direction of the spacers.

The image display apparatus according to the present invention and structured as described above incorporates the spacer stood erect between the anode substrate and the cathode substrate and capable of maintaining a predetermined distance between the anode substrate and the cathode substrate. The spacer of the image display apparatus is formed into a substantially rectangular shape. Tensions are added in a lengthwise pulling direction of the spacers, that is, in the lengthwise direction in which the spacer is elongated. Therefore, the spacer of the image display apparatus is able to prevent distortion and fracture even if the spacer is subjected to heat treatment.

To achieve the foregoing object, according to another aspect of the present invention, there is provided a method of manufacturing an image display apparatus having a structure that an anode substrate having a structure in which at least an image display portion is formed on a first substrate and a cathode substrate in which at least electron emission units are formed on a second substrate are disposed opposite to each other through spacers each of which formed into a substantially rectangular shape, the method of manufacturing an image display apparatus comprising the steps of: securing the two long sides of the spacers to at least either of the anode substrate or the cathode substrate, wherein tensions are added to the spacers in the lengthwise direction of the spacers.

The method of manufacturing an image display apparatus according to the present invention is structured such that the spacers are disposed between the anode substrate and the cathode substrate so that the cathode substrate and the anode substrate are disposed opposite to each other. The foregoing method is structured such that the spacers are secured in a state in which predetermined tensions are added in the lengthwise pulling direction of the spacer, that is, in a direction in which the spacer is elongated in the lengthwise direction. Therefore, the method according to the present invention is able to dispose the spacers without occurrence of distortion and fracture.

Other objects, features and advantages of the invention will be evident from the following detailed description of the preferred embodiments described in conjunction with the attached drawings.

DETAILED DESCRIPTION OF THE PREFERRED EMBODIMENT

Embodiments of an image display apparatus according to the present invention and a manufacturing method therefor will now be described with reference to the drawings.

Figure 1:
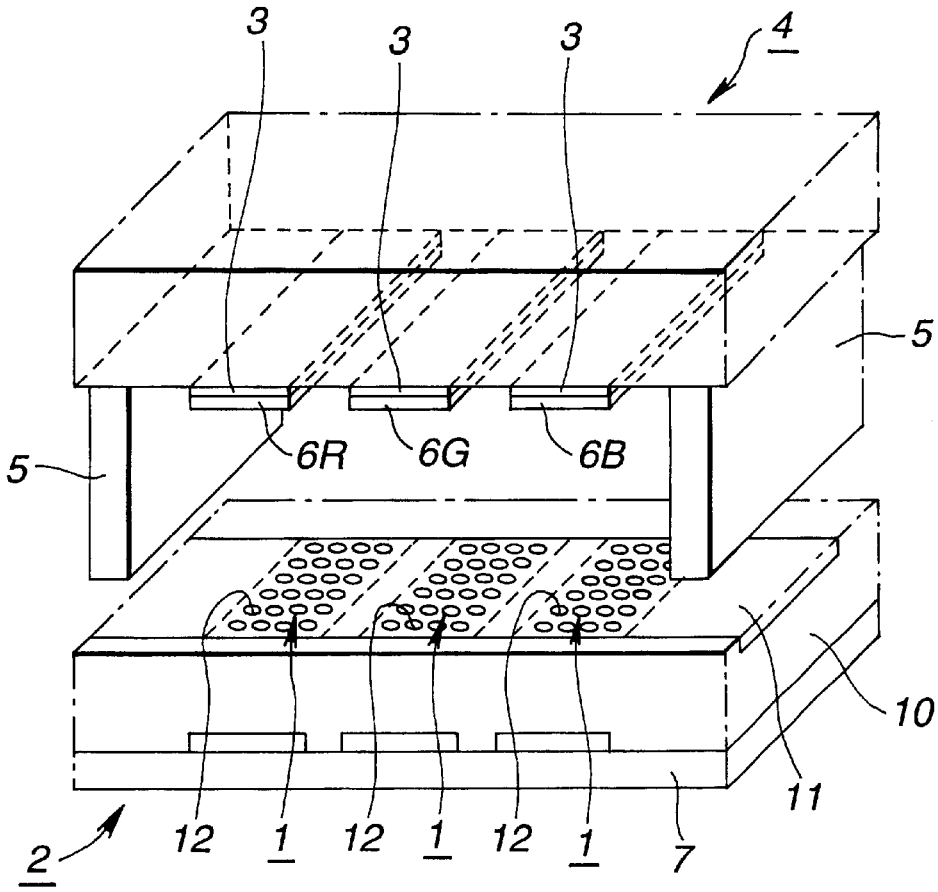
FIG. 1 is a schematic perspective view showing the structure of a FED which is an example of an image display apparatus according to the present invention.

As schematically shown in FIG. 1, electron emission units according to this embodiment is adapted to a field electron emission display which is a so-called FED (Field Emission Display). The FED incorporates a cathode substrate 2 having electron emission units 1 arranged to emit field electrons and disposed in a matrix configuration; an anode substrate 4 disposed opposite to the cathode substrate 2 and having anode electrodes 3 formed into stripe configuration and spacers 5 disposed between the cathode substrate 2 and the anode substrate 4.

The FED has a structure that a space between the cathode substrate 2 and the anode substrate 4 is a high vacuum state.

In the FED according to this embodiments, pressure caused from the atmosphere is exerted in a direction in which the cathode substrate 2 and the anode substrate 4 are joined to each other. However, the FED according to this embodiment has the spacers 5 stood erect between the cathode substrate 2 and the anode substrate 4 so that the cathode substrate 2 and the anode substrate 4 are disposed opposite to each other and apart from each other for a predetermined distance against the foregoing pressure.

The anode substrate 4 of the FED according to this embodiment has a structure that a red-light emission member 6R for emitting red light is formed on a predetermined anode electrode 3. A green-light emission member 6G for emitting green light is formed on an adjacent anode electrode 3. A blue-light emission member 6B for emitting blue light is formed on an adjacent anode electrode 3. That is, the anode substrate 4 has the red-light emission member 6R, the green-light emission member 6G and the blue-light emission member 6B (hereinafter collectively and simply called "fluorescent members 6") which are formed into alternating stripe shape.

Figure 2:
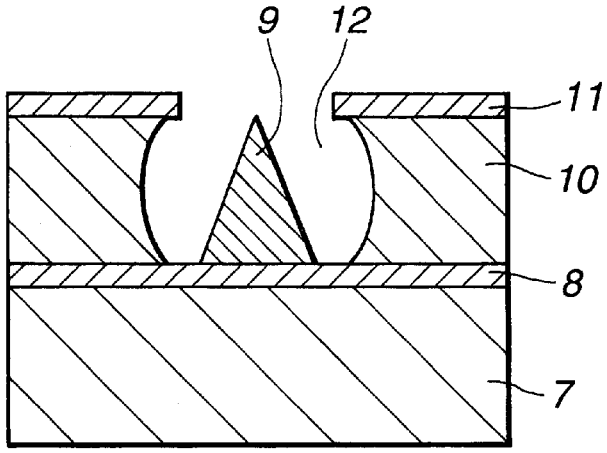
FIG. 2 is a cross sectional view showing an essential portion of an electron emission unit formed on the cathode substrate.

The cathode substrate 2 of the FED according to this embodiment incorporates a plurality of electron emission units 1 disposed in a matrix configuration. As shown in FIG. 2, the electron emission units 1 are so-called spindt-type electron emission units. Each electron emission units 1 incorporates an insulating substrate 7 made of glass or the like; a cathode electrode 8 formed on the insulating substrate 7; a conical emitter electrode 9 formed on the cathode electrode 8; and a gate electrode 11 disposed apart from the emitter electrode 9 for a predetermined distance and laminated through the cathode electrode 8 and the insulating layer 10. The FED has the cathode electrode 8 formed into a stripe configuration in parallel with the anode electrode 3 and the fluorescent members 6. Moreover, a gate electrode 11 is formed into a stripe configuration in a direction perpendicular to the cathode electrode 8. The FED according to this embodiment has the electron emission units 1 formed at intersections between the cathode electrodes 8 and the gate electrodes 11. Therefore, the FED according to this embodiment has the electron emission units 1 disposed in the matrix configuration.

When the electron emission units 1 are manufactured, a plurality of small openings 12 which penetrate the gate electrode 11 and the insulating layer 10 are formed in the intersections regions formed in the matrix configuration. That is, when the electron emission units 1 are manufactured, the plural openings 12 are formed in such a manner that the cathode electrode 8 is exposed in the bottom portion. Then, a thin film made of a discharge material is formed in the opening 12 from a diagonal position by evaporation or the like so that a conical emitter electrode 9 is formed.

The FED according to this embodiment has pixels each of which is constituted by the fluorescent members 6 in the three colors and the electron emission units 1 disposed opposite to the fluorescent members 6 in the three colors. In the FED, the pixels constituted as described above are disposed in the matrix configuration.

Figure 3:
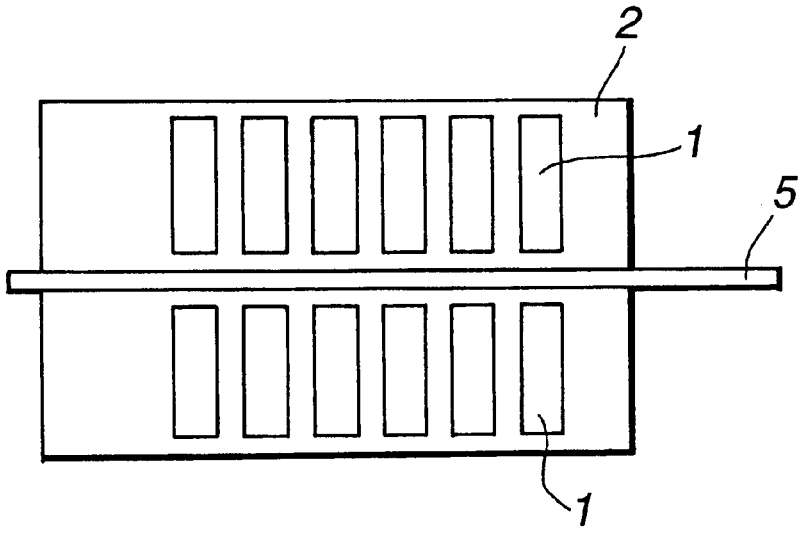
FIG. 3 is a schematic view showing the positions of spacers.

Each of the spacers 5 of the foregoing FED is formed into a substantially rectangular shape such that the spacers 5 are stood erect between the anode substrate 4 and the cathode substrate 2. At this time, the spacers 5 are temporarily joined to either of the cathode substrate 2 or the anode substrate 4. In this embodiment, the spacers 5 are joined to the cathode substrate 2. The procedure is not limited to the foregoing method. As a matter of course, the spacers 5 may be joined to the anode substrate 4. Specifically, the spacers 5 are joined between the electron emission units 1 disposed in the matrix configuration, as shown in FIG. 3. Namely, the spacers 5 are disposed between pixels structured as described above, that is, in the ineffective pixel regions. In the FED according to this embodiment, it is preferable that a plurality of the spacers 5 are uniformly disposed in the plane of the screen.

Figure 4:
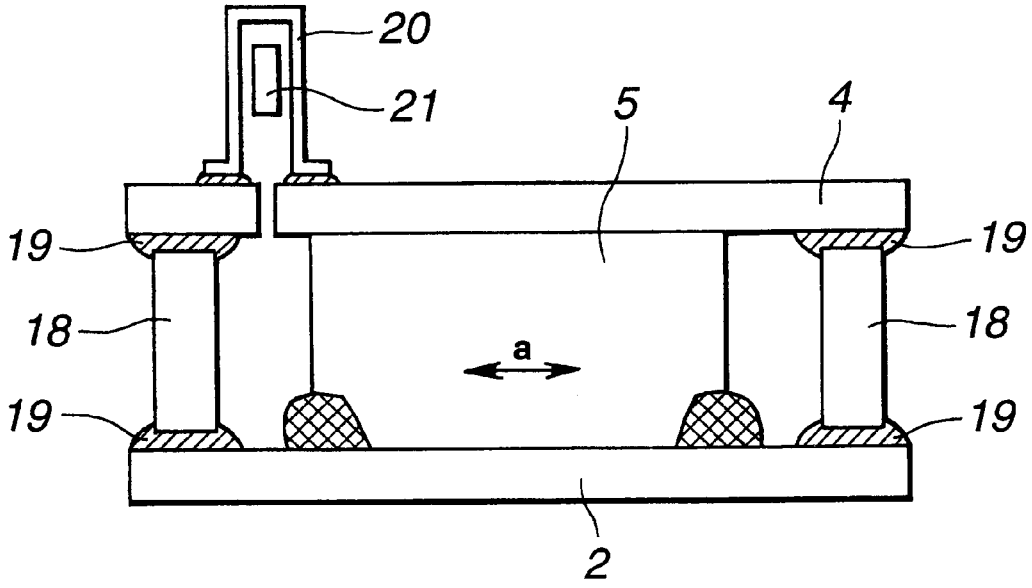
FIG. 4 is a vertical cross sectional view showing an essential portion of the image display apparatus according to the present invention.
Figure 5:
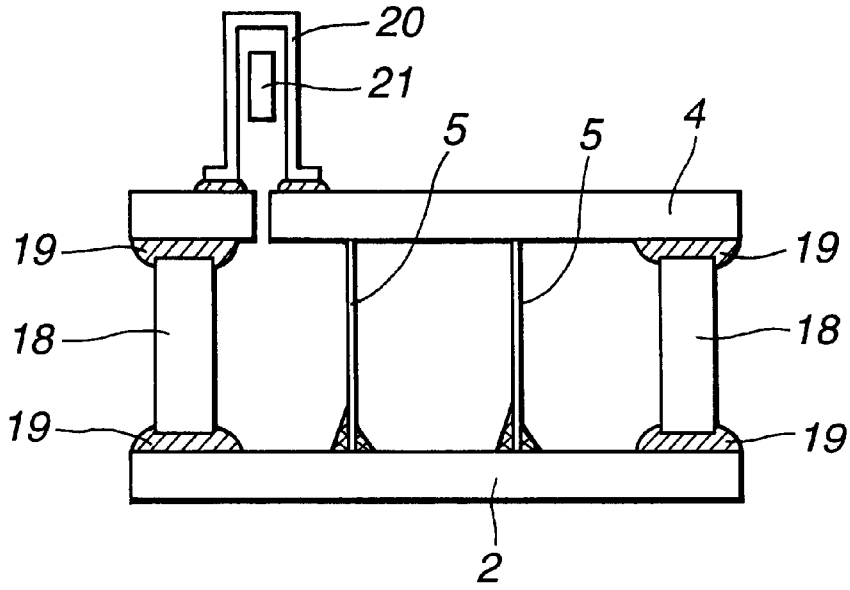
FIG. 5 is a vertical cross sectional view showing an essential portion of the image display apparatus according to the present invention.

As shown in FIGS. 4 and 5, the spacers 5 are secured such that the two long sides of the spacers 5 are bonded to the cathode substrate 2 with adhesive agent. As indicated with an arrow a shown in FIG. 4, tensions are added to the spacer 5 in a lengthwise pulling direction. As shown in FIGS. 4 and 5, the cathode substrate 2 and the anode substrate 4 maintain a predetermined distance through an outer wall 18. The outer wall 18 has substantially the same shape as the shape of each of the cathode substrate 2 and the anode substrate 4. The outer wall 18 is joined to the cathode substrate 2 and the anode substrate 4 through frit glass 19. Therefore, the FED has a structure that the cathode substrate 2, the anode substrate 4, the outer wall 18 and the frit glass 19 prevent leakage of air from the inside portion of the FED.

To maintain a predetermined degree of vacuum in the FED, the FED has an exhaust pipe 20 which is connected to a vacuum exhausting apparatus (not shown). A gas adsorber 21 is disposed in the exhaust pipe 20. Thus, the vacuum exhausting apparatus (not shown) is joined to the FED through the exhaust pipe 20 so that the internal space formed by the cathode substrate, the anode substrate and the outer wall 18 is made to be a vacuum state. After the vacuum state has been realized, the gas adsorber 21 adsorbs gas component left in the foregoing internal space so as to maintain a high vacuum state in the internal space.

When the spacer 5 is stood erect on the cathode substrate 2, the temperature of the spacer 5 is made to be higher than the temperature of the cathode substrate 2. Then, the two long sides of the spacer 5 are secured to the cathode substrate 2. Namely, the temperature of the spacer 5 is made to be higher than the temperature of the cathode substrate 2 so that the spacer 5 expanded with heat is secured to the cathode substrate 2. When the temperature of the spacer 5 and that of the cathode substrate 2 have been made to be substantially the same after the securing process, the spacer 5 is contracted. As a result, the spacer 5 is secured to the cathode substrate 2 in a state in which tensions are added in the lengthwise pulling directions.

Figure 6:
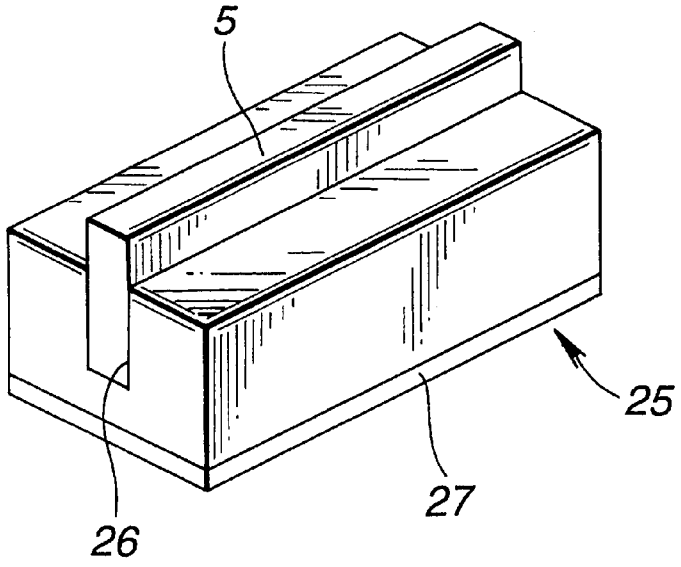
FIG. 6 is a perspective view showing a state in which the spacer has been joined to a jig which is used when the spacer is secured to the cathode substrate.

Specifically, a jig 25 structured as shown in FIG. 6 is used to secure the spacer 5 to the upper surface of the cathode substrate 2. The jig 25 is made of a material, such as metal, having high heat conductivity. The jig 25 has a groove 26 for receiving the spacer 5 and a heater 27 for heating the inserted spacer 5.

As shown in FIG. 6, the jig 25 is heated by the heater 27 in a state in which the spacer 5 has been inserted into the groove 26. Thus, the spacer 5 is heated to a predetermined level. Specifically, it is preferable that the jig 25 heats the inserted spacer 5 to a level which is higher than the temperature of the cathode substrate 2 by about 10° C. to about 100° C. At this time, the spacer 5 is expanded because the spacer 5 has been heated to the predetermined level.

Figure 7:
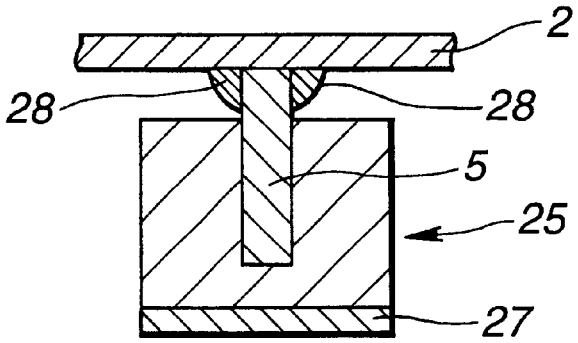
FIG. 7 is a cross sectional view showing an essential portion of a state in which the cathode substrate has been secured to the spacer.

In a state in which the predetermined temperature of the spacer 5 is maintained, the cathode substrate 2 having an adhesive agent 28 allowed to adhere to predetermined positions thereof and the spacer 5 are accurately positioned and brought into contact with each other, as shown in FIG. 7. That is, the spacer 5 expanded owing to heat is secured to the surface of the cathode substrate 2. It is preferable that the adhesive agent 28 is an ultraviolet curing adhesive agent. When the ultraviolet curing adhesive agent is employed, the adhesive agent 28 can easily be cured by applying ultraviolet rays after the cathode substrate 2 and the spacer 5 have been brought into contact with each other. Therefore, use of the ultraviolet curing adhesive agent facilitates bonding of the cathode substrate 2 and the spacer 5.

Figure 8:
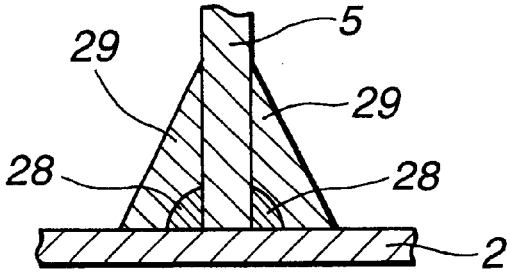
FIG. 8 is a cross sectional view showing an essential portion essential portion of a state in which a protective film has been formed on an adhesive agent.

Then, as shown in FIG. 8, the spacer 5 is removed from the jig 25, and then a protective film 29 is formed to cover the adhesive agent 28. It is preferable that the protective film 29 is made of a heat resisting inorganic adhesive agent. Since the protective film 29 covers the adhesive agent 28, the spacer 5 can reliably be secured to the cathode substrate 2 if the adhesiveness of the adhesive agent 28 is deprived owing to heat treatment which will be performed later.

Figure 9:
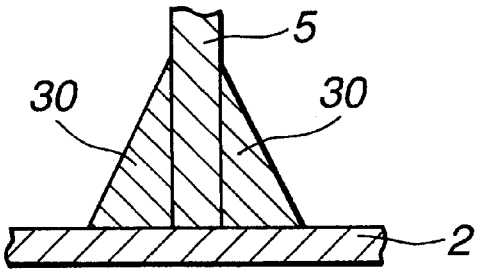
FIG. 9 is a cross sectional view showing an essential portion of each of the spacer and the cathode substrate in a case where an inorganic adhesive agent is employed.

When the spacer 5 and the cathode substrate 2 are bonded to each other, only an inorganic adhesive agent 30 may be employed, as shown in FIG. 9. It is preferable that the inorganic adhesive agent 30 is an agent which is cured in a short time owing to application of a laser beam or the like which, therefore, is capable of reliably bonding the spacer 5 and the cathode substrate 2 to each other. The adhesiveness of the inorganic adhesive agent 30 of the foregoing type is not deprived if the heat treatment is performed afterwards. Thus, the spacer 5 and the cathode substrate 2 can reliably be bonded to each other.

As described above, the temperature of the spacer 5 is higher than that of the cathode substrate 2. In the foregoing state, the spacer 5 is secured to the cathode substrate 2. Thus, predetermined tensions can be applied in the lengthwise direction of the spacer 5 after the temperatures of the spacer 5 and the cathode substrate 2 have been made to substantially be the same. That is, the foregoing method enables the spacer 5 to be secured to the cathode substrate 2 in the state in which the predetermined tensions are added in the lengthwise direction of the spacer 5.

Similarly, a plurality of the spacers 5 are sequentially secured to the cathode substrate 2 in a manner not shown. Thus, the plural spacers 5 can be stood erect at predetermined regions.

The present invention is not limited to the foregoing method of standing erect the spacers 5 on the cathode substrate 2. For example, the spacers 5 may be secured to the cathode substrate 2 which has been cooled. That is, the cathode substrate 2 is cooled so as to be contracted, and then the spacers 5 are secured to the contracted cathode substrate 2. When the temperature of the cathode substrate 2 and the temperature of the spacers 5 have been made to be substantially the same after the securing process, the cathode substrate 2 is expanded owing to heat. Thus, the foregoing tensions are added in the lengthwise direction of the spacers.

The FED structured as described above incorporates the plate-like spacers 5 which are disposed to maintain a predetermined distance between the cathode substrate 2 and the anode substrate 4 against high pressure generated owing to the atmosphere. If the cathode substrate 2 and the anode substrate 4 of the FED comprise thin glass substrates, fracture of the FED occurring owing to the foregoing pressure can reliably be prevented. That is, the FED according to the present invention is able to employ thin glass substrates. Therefore, the thickness of the FED can be reduced as compared with a conventional FED.

Since the tensions are added in the lengthwise direction of the spacers 5, the spacers 5 can be disposed without distortion. Therefore, the accuracy of the positions of the two ends of the spacers 5 which are secured to the cathode substrate 2 can be improved. As a result, undesirable covering of the electron emission unit 1 with the spacer 5 can be prevented. Thus, an excellent accuracy of the positions can be improved. Therefore, the foregoing FED is able to prevent undesirable exposure of the spacer 5 to the effective pixel region. Hence it follows that satisfactory brightness of a displayed image can be maintained.

An assumption is made that a spacer 5 made of zirconia (having a Young's modulus of 210 GPa) having the thermal expansion coefficient $\alpha s$ of $100\times10^{-7}$ is heated to 60° C., followed by securing the spacer 5 to the cathode substrate 2, the temperature of which is 20° C. In the foregoing state, the extension coefficient $\beta$ of the spacer 5 can be obtained as $(100\times10^{-7})\times(60-20)$ from $\beta=\alpha s\times\Delta t$ ($\Delta t$ is a variation which takes place owing to the temperature). The stress of the tension which is added to the spacer 5 secured to the cathode substrate 2 is $8.4\times10^{7}$ (Pa) according to the Hooke's law $T=E\epsilon$ (E is a Young's modulus and E is an extension coefficient). As described above, the spacer 5 made of zirconia is added with the tension $8.4\times10^{7}$ (Pa). Therefore, deviation of the position of the spacer 5 can be prevented.

The foregoing FED is sometimes subjected to heat treatment. If the thermal expansion coefficient of the spacer 5 and that of the cathode substrate 2 are different from each other, there is apprehension that the heat treatment causes the spacer 5 to be distorted during the heat treatment or the spacer 5 is broken. In general, if the spacer 5 and the cathode substrate 2 encounter different expansion or contraction owing to heat during a predetermined change in the temperature, the difference in the expansion or contraction owing to heat results in the spacer 5 being distorted or the spacer 5 being broken.

The foregoing FED is sometimes subjected to a cooling test. That is, the temperature of the FED is made to be a level not higher than a so-called guaranteed temperature to evaluate the characteristics of the FED. If the thermal expansion coefficient of the spacer 5 and that of the cathode substrate 2 are different from each other, there is apprehension that the cooling test causes the spacer 5 to be distorted or the spacer 5 to be broken.

Therefore, the foregoing FED is structured such that the following factors are controlled to satisfy predetermined conditions: thermal expansion coefficient of the spacer 5, the thermal expansion coefficient of the cathode substrate 2, the temperature at which the spacer 5 is stood erect, the temperature to which the spacer 5 is heated after the spacer 5 has been stood erect and the temperature of the spacer 5 to which the spacer 5 is cooled after the spacer 5 has been stood erect. Thus, distortion and breakage of the spacer 5 can reliably be prevented.

Assumptions are made that the thermal expansion coefficient of the spacer 5 is $\alpha s$, the thermal expansion coefficient of the cathode substrate 2 is $\alpha g$, (temperature at which the spacer 5 is stood erect)−(temperature of the cathode substrate 2 when the spacer 5 is stood erect) is $\Delta t1$, (temperature to which the spacer 5 is heated after the spacer 5 has been stood erect)−(temperature of the cathode substrate 2 when the spacer 5 is stood erect) is $\Delta t2$ and (temperature to which the spacer 5 is cooled after the spacer 5 has been stood erect)−(the temperature of the cathode substrate 2 when the spacer 5 is stood erect) is $\Delta t3$. Another assumption is made that the maximum thermal expansion coefficient of the spacer 5 within limit of pulling is $\epsilon$.

If $\alpha s\leqq\alpha g$, it is preferable that the following expression are satisfied:

$$\alpha s\times\Delta t1+(\alpha g-\alpha s)\times\Delta t2<\epsilon \quad (1)$$

$$\alpha s\times\Delta t1-(\alpha g-\alpha s)\times\Delta t3>0 \quad (2)$$

If $\alpha s\geqq\alpha g$, it is preferable that the following expressions are satisfied:

$$\alpha s\times\Delta t1+(\alpha g-\alpha s)\times\Delta t2>0 \quad (3)$$

$$\alpha s\times\Delta t1-(\alpha g-\alpha s)\times\Delta t3<\epsilon \quad (4)$$

When the thermal expansion coefficient of the spacer 5 is not higher than that of the cathode substrate 2 (when $\alpha s\leqq\alpha g$), heating causes the cathode substrate 2 to furthermore be expanded. On the other hand, the spacer 5 is relatively contracted. As a result, the spacer 5 secured to the cathode substrate 2 is added with a tension in the pulling direction. In the foregoing case, cooling causes the cathode substrate 2 to furthermore be contracted. On the other hand, the spacer 5 is relatively expanded. As a result, the spacer 5 secured to the cathode substrate 2 is added with a tension in the contracting direction.

When the thermal expansion coefficient of the spacer 5 is not lower than that of the cathode substrate 2 (when $\alpha s\geqq\alpha g$), heating causes the spacer 5 to furthermore be expanded. On the other hand, the cathode substrate 2 is relatively contracted. As a result, the spacer 5 secured to the cathode substrate 2 is added with a tension in the contracting direction. In the foregoing case, cooling causes the spacer 5 to furthermore be contracted. On the other hand, the cathode substrate 2 is relatively expanded. As a result, the spacer 5 secured to the cathode substrate 2 is added with a tension in the pulling direction.

In the expressions (1), (2), (3) and (4), expression "$\alpha s\times\Delta t1$" indicates tension exerted on the spacer 5 when the spacer 5 is secured. Expression "$(\alpha g-\alpha s)\times\Delta t2$" indicates an amount of expansion/contraction of the spacer 5 occurring after heating has been performed and caused from the difference in the thermal expansion coefficient of the spacer 5 and that of the cathode substrate 2. Expression "$(\alpha g-\alpha s)\times\Delta t3$" indicates an amount of expansion/contraction of the spacer 5 occurring after cooling has been performed and caused from the difference in the thermal expansion coefficient of the spacer 5 and that of the cathode substrate 2. Therefore, the expression (1) shows a requirement that a total of the tensions in the pulling direction added to the spacer 5 when heating is performed must be smaller than the thermal expansion coefficient $\epsilon$ within the limit of the tensile strength of the spacer 5. When the expression (1) is satisfied, breakage of the spacer 5 during heating can reliably be prevented.

The expression (2) shows a requirement that the tension in the contracting direction which is added to the spacer 5 when cooling is performed must be smaller than the tension exerted when the spacer 5 is secured. When the expression (2) is satisfied, distortion of the spacer 5 during cooling can reliably be prevented.

The expression (3) shows a requirement that the tension in the contracting direction which is added to the spacer 5 is smaller than the tension exerted when the spacer 5 is secured. When the expression (3) is satisfied, distortion during heating can reliably be prevented.

The expression (4) shows a requirement that a total of the tensions in the pulling direction which are added to the spacer 5 during cooling must be smaller than the maximum thermal expansion coefficient $\epsilon$ within the limit of the tensile strength of the spacer 5. When the expression (4) is satisfied, breakage of the spacer 5 during cooling can reliably be prevented.

Figure 10:
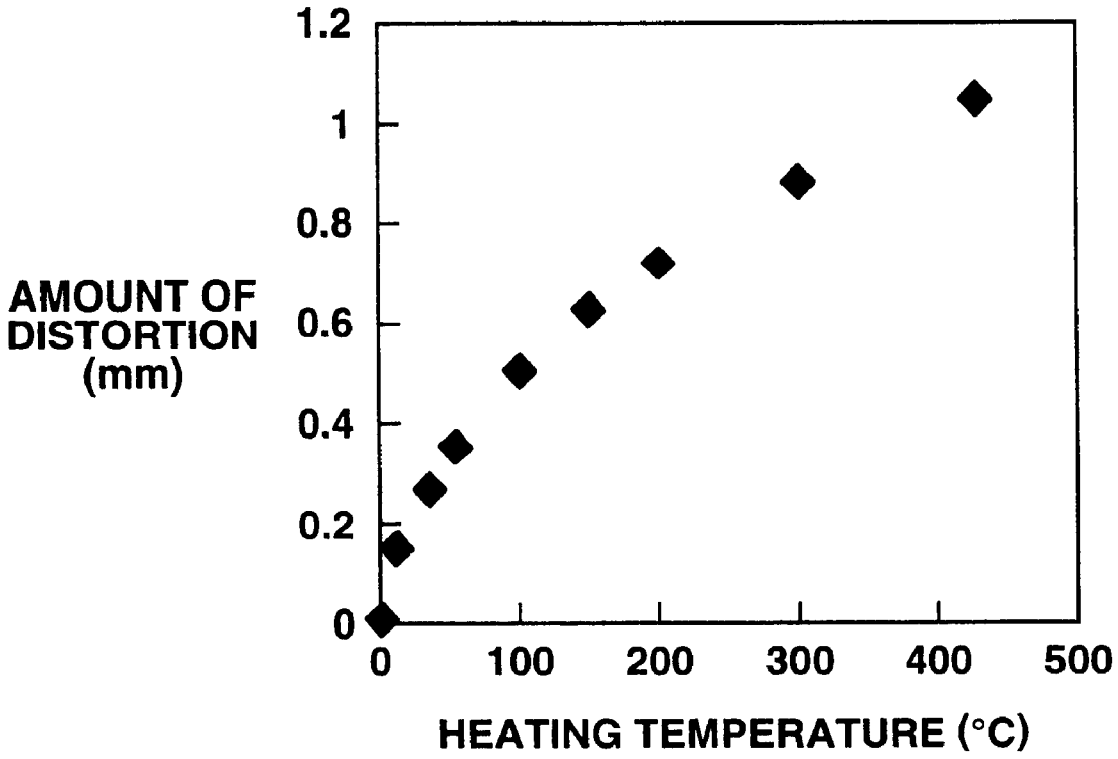
FIG. 10 is a graph showing the relationship between temperatures at which the zirconia spacer is heated and amounts of distortion of the spacer.

When the spacer is secured to the surface of the cathode substrate in a state in which the predetermined tension is not added to the spacer, excessive distortion and/or breakage takes place. If a plate-like spacer having a thermal expansion coefficient which is smaller than that of the cathode substrate by $5\times10^{-7}$/° C. and a width of 50 $\mu$m and a length of 100 mm in a state in which heating to 450° C. is performed after the spacer has been secured, distortion not larger than 1 mm occurs when heating is performed, as shown in FIG. 10. When the foregoing heat treatment is performed after the cathode substrate to which the spacer has been secured and the anode substrate have been disposed opposite to each other, the plate-like spacer undesirably projects through the gap between the adjacent electron emission units. As a result, the fluorescent member disposed on the anode substrate is sometimes critically damaged. In the foregoing case, the FED undesirably displays a defective image.

The FED according to the foregoing embodiment are structured to satisfy the expressions (1), (2), (3) and (4). Therefore, distortion and breakage can be prevented if the heat treatment and the cooling test are performed. Therefore, a state in which a predetermined tension is applied can be maintained. As a result, the spacers 5 can accurately be disposed even if the heat treatment and the cooling test are performed. Therefore, the fluorescent members 6 disposed on the anode substrate 4 of the FED can be protected from a damage. As a result, the FED according to the present invention is able to reliably display a satisfactory image free from lowering of the brightness.

As described above, the image display apparatus according to the present invention has the structure that the two ends of the spacer is secured to at least either of the anode substrate or the cathode substrate in a state in which a tension is added to the spacer in the lengthwise direction of the spacer. Therefore, the image display apparatus according to the present invention is able to prevent distortion and breakage of the spacer thereof. Moreover, the spacers can be disposed at required positions. Therefore, the image display apparatus according to the present invention is free from lowering of the brightness of a displayed image and enabled to have satisfactory strength against high pressure.

The method of manufacturing the image display apparatus according to the present invention is structured such that the spacers are joined in a state in which a predetermined tension is added to each spacer in the lengthwise direction of the spacer. Therefore, the spacers can accurately be joined.

Although the invention has been described in its preferred form and structure with a certain degree of particularity, it is understood that the present disclosure of the preferred form can be changed in the details of construction and in the combination and arrangement of parts without departing from the spirit and the scope of the invention as hereinafter claimed.

What is claimed is:

1. An image display apparatus comprising:

an anode substrate having a structure in which at least an image display portion is formed on a first substrate;

a cathode substrate in which at least electron emission units are formed on a second substrate and which is disposed opposite to said anode substrate; and a plurality of spacers, each of which is formed into a substantially rectangular shape and which are stood erect between said anode substrate and said cathode substrate, wherein two long sides of each of said spacers are secured to at least either of said anode substrate or said cathode substrate, wherein said spacers are formed at a predetermined tension in a direction lengthwise of said spacers, wherein a thermal expansion coefficient of said spacer is defined $\alpha s$, a thermal expansion coefficient of said anode substrate or said cathode substrate on which said spacer stands erect is defined as $\alpha g$, a difference between a temperature of said spacer at which said spacer is stood erect and a temperature of said substrate when said spacer stands erect is defined as $\Delta t\mathbf{1}$, a difference between a temperature at which said spacer is heated after said spacer has been stood erect and the temperature of said substrate when said spacer stands erect is defined as $\Delta t\mathbf{2}$, a difference between a lowest temperature at which preservation is permitted and a temperature of said substrate when said spacer stands erect is defined as $\Delta t\mathbf{3}$ and a maximum thermal expansion coefficient of said spacer within limit of pulling is $\epsilon$, and wherein if $\alpha s \leqq \alpha g$, the following expression are satisfied:

$$\alpha s\times\Delta t\mathbf{1}+(\alpha g-\alpha s)\times\Delta t\mathbf{2}<\epsilon$$

$$\alpha s\times\Delta t\mathbf{1}-(\alpha g-\alpha s)\times\Delta t\mathbf{3}>0$$

if $\alpha s \geqq \alpha g$, the following expressions are satisfied:

$$\alpha s\times\Delta t\mathbf{1}+(\alpha g-\alpha s)\times\Delta t\mathbf{2}>0$$

$$\alpha s\times\Delta t\mathbf{1}-(\alpha g-\alpha s)\times\Delta t\mathbf{3}<\epsilon.$$

2. An image display apparatus according to claim 1, wherein a thermal expansion coefficient of said spacer is defined $\alpha s$, a thermal expansion coefficient of said anode substrate or said cathode substrate on which said space stands erect is defined as $\alpha g$, a difference between a temperature of said spacer at which said spacer is stood erect and a temperature of said substrate when said spacer stands erect is defined as $\Delta t\mathbf{1}$, a difference between a temperature at which said spacer is heated after said spacer has been stood erect and the temperature of said substrate when said spacer stands erect is defined as $\Delta t\mathbf{2}$, a difference between a lowest temperature at which preservation is permitted band a temperature of said substrate when said spacer stands erect is defined as $\Delta t\mathbf{3}$ and a maximum thermal expansion coefficient of said spacer within limit of pulling is $\epsilon$, and wherein if $\alpha s \leqq \alpha g$, the following expression are satisfied:

$$\alpha s\times\Delta t\mathbf{1}+(\alpha g-\alpha s)\times\Delta t\mathbf{2}<\epsilon$$

$$\alpha s\times\Delta t\mathbf{1}-(\alpha g-\alpha s)\times\Delta t\mathbf{3}<0$$

if $\alpha s \geqq \alpha g$, the following expressions are satisfied:

$$\alpha s\times\Delta t\mathbf{1}+(\alpha g-\alpha s)\times\Delta t\mathbf{2}<0$$

$$\alpha s\times\Delta t\mathbf{1}-(\alpha g-\alpha s)\times\Delta t\mathbf{3}<\epsilon.$$

3. An image display apparatus according to claim 1, further comprising:

said anode substrate has red-, green-, and blue-light fluorescent emission members formed on predetermined anode electrodes in an alternating stripe configuration.

4. An image display apparatus according to claim 1, further comprising:

said cathode substrate incorporates a plurality of spindt-type electron emission units in a matrix configuration.

5. An image display apparatus according to claim 4, wherein each electron emission unit further comprises:

an insulating substrate;

a cathode electrode formed on said insulating substrate;

a conical emitter electrode formed on said cathode electrode;

a gate electrode disposed apart from the emitter electrode by a predetermined distance and laminated through the cathode electrode and an insulating layer.

6. An image display apparatus according to claim 3, further comprising:

cathode electrodes formed into an alternating stripe configuration in parallel with the anode electrodes and the fluorescent members.

7. An image display apparatus according to claim 1, further comprising:

said spacers are secured to either the anode or cathode substrate with an ultraviolet curing adhesive agent, and are uniformly disposed in the plane of the image display portion.

8. An image display apparatus according to claim 1, further comprising:

an outer wall is joined to the cathode and anode substrates through frit glass.

9. An image display apparatus according to claim 1, further comprising:

a space between the cathode and anode substrates is maintained at a predetermined degree of vacuum.

10. An image display apparatus according to claim 9, further comprising:

said vacuum is maintained through use of an exhaust pipe and a gas absorber.

* * * * *

UNITED STATES PATENT AND TRADEMARK OFFICE

CERTIFICATE OF CORRECTION

PATENT NO. : 6,483,235 B1
DATED : November 19, 2002
INVENTOR(S) : Yukinobu Iguchi It is certified that error appears in the above-identified patent and that said Letters Patent is hereby corrected as shown below:

Column 10,
Lines 43-67, delete from "An image thru 4 equations" and insert -- 2. An image display apparatus according to Claim 1, wherein said spacers are secured to said cathode substrate. --.

Signed and Sealed this

First Day of April, 2003

JAMES E. ROGAN
*Director of the United States Patent and Trademark Office*